US006029816A

United States Patent [19]

Goodwin et al.

[11] Patent Number: 6,029,816

[45] Date of Patent: Feb. 29, 2000

[54] PACKAGING

[75] Inventors: David M Goodwin, Pyrford; Nicholas Mernor Hamnett, Epson, both of United Kingdom

[73] Assignee: Parker Pen Products, Isleworth, United Kingdom

[21] Appl. No.: 09/099,495

[22] Filed: Jun. 18, 1998

Related U.S. Application Data

[63] Continuation of application No. PCT/GB96/03087, Dec. 13, 1996.

[30] Foreign Application Priority Data

Dec. 20, 1995 [GB] United Kingdom ..... 9526077

[51] Int. Cl.[7] ..... B65D 85/28

[52] U.S. Cl. ..... 206/371; 206/214

[58] Field of Search ..... 206/38, 214, 224, 206/263, 365, 371, 581

[56] References Cited

U.S. PATENT DOCUMENTS

| | | | |
|---|---|---|---|
| 2,651,407 | 9/1953 | Blackman | 206/43 |
| 4,244,660 | 1/1981 | Aronson | 402/79 |
| 4,736,838 | 4/1988 | Nakata et al. | 206/45.18 |
| 5,186,320 | 2/1993 | Aida | 206/45.19 |

*Primary Examiner*—David T. Fidei
*Attorney, Agent, or Firm*—Ladas & Parry

[57] ABSTRACT

A case for elongate articles, such as writing instruments, includes a base and a cover hinged to the base for movement between open and closed positions. The base carries an article holder for receiving and holding an article in the case. The cover carries or is adapted to carry a holder for receiving and holding a second article in the case and in a position laterally alongside the article held on the base when the case is closed.

15 Claims, 4 Drawing Sheets

PACKAGING

This Application is a Continuation of PCT/GB96/03087 Dec. 13, 1996.

FIELD OF THE INVENTION

This invention relates to the field of packaging, and in particular it concerns presentation cases.

DESCRIPTION OF THE RELATED ART

It is common for some products to be sold in presentation cases which can serve as gift boxes in the event that the customer wishes to give the product to another person as a present and/or serve as a storage container for keeping the product safe from loss or damage. Products commonly sold in presentation cases are writing instruments, and the present invention is directed especially to a case suitable for writing instruments or similarly shaped elongate articles.

Writing instruments are frequently sold in sets, e.g. pen and pencil or ball pen and fountain pen, as well as individually. In general different presentation cases are needed for sets of writing instruments to those used for individual instruments. If a case adapted to receive two instruments is used for a single instrument, it can give the wrong impression that a second instrument should have been included, but has not been inserted into the case or has been removed.

BRIEF SUMMARY OF THE INVENTION

In accordance with the present invention there is provided a case for elongate articles, such as writing instruments, comprising a base, a cover hinged to the base for movement between open and closed positions, article holding means carried by the base for receiving and holding an article in the case, and wherein the cover carries or is adapted to carry a holding means for receiving and holding a second article in the case and in a position laterally alongside the article held on the base when the case is closed.

With means for holding respective articles carried on the base and cover, the case can be used for one or two articles without giving rise to any misconceived idea that, when only one article is present, a second article should be enclosed and is missing, especially when, as preferred, the holding means are arranged to hold the articles in close juxtaposition. A close juxtaposition, rather than having the articles widely spaced apart or directly above each other also has the advantage that the case does not need to be made excessively deep and it can have a narrow width enabling a compact overall design. The holding means can take different forms, such as resilient retaining projections formed integrally with the base and cover and arranged to embrace the articles to be held. In a preferred construction, however, the holding means comprise inserts of resilient material, e.g. rubber or other elastomeric material, which are firmly attached to the base and cover and positioned to grip the portions of the articles medially along their length.

Writing instruments are a class of article for which aesthetic appearance is important, it usually being a major factor which will influence the decision of a prospective purchaser. Frequently writing instruments have surface finishes which can be marred by scratching. When supplied in a presentation case, a writing instrument needs to be held securely in the case so that it will not become dislodged and become free to move around in the case, which might result in surface damage. In addition, there is a need for the instrument to be easily removable and replaceable by the user.

There are, therefore, contradictory requirements of the holding means in that the writing instrument must be held firmly, while facilitating removal and insertion of the instrument, but without risk of the holding means itself scratching or otherwise causing blemishes to the surface finish, even with repeated removal and insertion of the writing instrument.

In accordance with a second aspect of the invention there is provided a writing instrument case having a gripping device for holding a writing instrument, the gripping device comprising a channel to receive a minor lengthwise section of the instrument for the instrument to be gripped between the opposed side walls of the channel, each of said side walls including at least two laterally deformable elements spaced along the channel for resilient engagement with the instrument.

In one embodiment the channel is formed by a plastics part integral with the case, and the channel side walls are slotted to define upwardly directed fingers, the free upper ends of which can deflect resiliently in the lateral direction to facilitate removal of the writing instrument from and insertion of the writing instrument into the gripping device.

Preferably the channel side walls are formed of elastomeric material and each side wall has integral protrusions which may be directed inwardly substantially perpendicular to the length of the channel, or may be inclined longitudinally. In one particular embodiment each side wall has at least one inwardly directed protrusion inclined longitudinally in the one direction along the channel and at least one second inwardly directed protrusion inclined longitudinally in the other direction. Most conveniently the protrusions comprise elongate ribs extending in the direction from the channel mouth towards the channel bottom wall. The elastomeric side walls can be provided by a unitary, integrally moulded gripping device, and may in order to obtain the required stiffness while maintaining the softness needed to ensure a gentle but secure gripping action, the side walls can be reinforced by substantially rigid parts conveniently integral with the case.

The preferred form of gripping device provided in accordance with the invention has been found very effective in holding a writing instrument securely, especially against displacement in a longitudinal direction as tends to occur if the presentation case in which the instrument is enclosed is dropped on its end, but the device can grip the instrument in a gentle manner avoiding the risk of causing damage to the surface of a writing instrument when the instrument is inserted into and removed from the gripping device.

Some writing instrument presentation cases embodying the invention, in its different aspects as described above, will now be described in more detail with reference to the accompanying drawings in which:

DETAILED DESCRIPTION OF THE INVENTION

Figure 5:
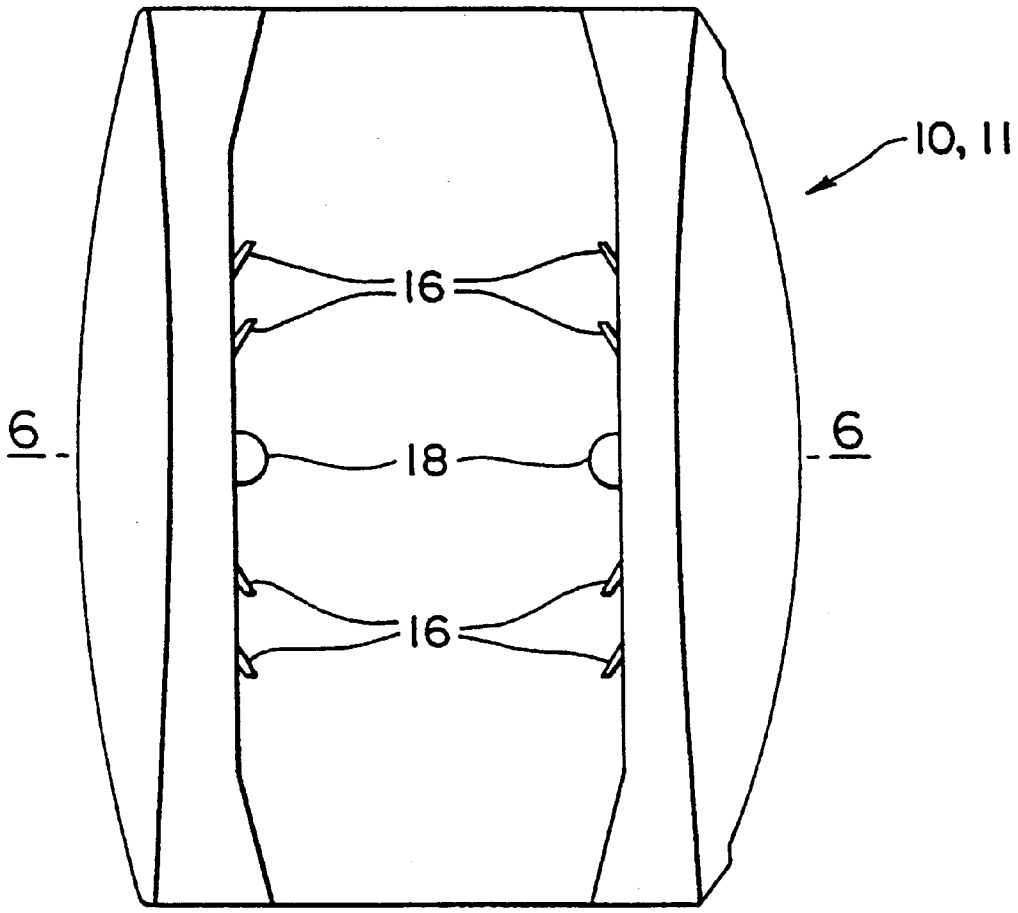
FIG. 5: shows a gripping device in an enlarged scale plan view.
Figure 6:
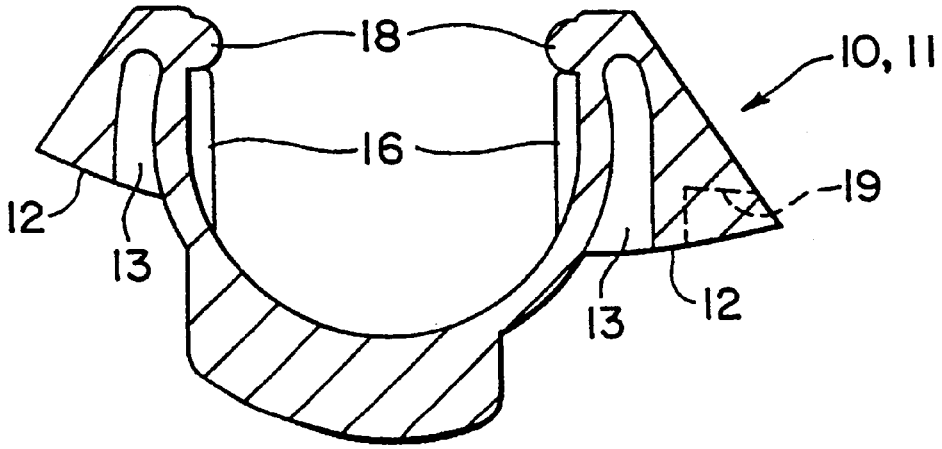
FIG. 6: is a section taken along the line VI—VI in FIG. 5.

Illustrated in FIGS. 1–4 is a presentation case for one or two writing instruments, such as a pen and pencil set. The case has a base 1 of generally rectangular configuration and a cover 2 of similar configuration connected to the base by a hinge 3, for example moulded integrally with the base and cover. The hinge allows the cover to be adjusted between the closed position shown in FIG. 3 and the fully open position of FIGS. 1 and 2. At their free longitudinal edges the cover and base are provided with a catch mechanism, the cover having a tongue 4 which latches with a snap action over a lip 5 on the base for holding the case shut. The main walls 6, 7 curved in transverse cross-section; as seen FIGS. 2 and 3, and are provided with elongate shallow grooves 8, 9 on their inner faces defining seats in which respective writing instruments are intended to sit. For retaining the writing instruments in these seats the base and cover are fitted with inserts 10, 11 of elastomeric material which serve as gripping devices. The two gripping devices may be moulded from rubber, polyethylene of other elastomeric material and conveniently are identical in form. As best seen in FIGS. 5 and 6, each gripping device comprises a channel shaped member with a curved bottom wall and opposed side walls. The outer faces of the side walls flare outwardly and the side walls defined external shoulders 12 directed away from the channel mouth and adapted to rest against the inner surface of the base or cover 1, 2 either side of the groove 8, 9 in which the curved bottom wall of the gripping member sits. Extending upwardly into the side walls form the shoulders 12 are sockets 13 and projections 14 integrally formed on the inside of the cover or base to which the member is fitted are engaged in these sockets for retaining the gripping member on the base or cover. As the base and cover are made of relatively rigid material, the projections 14 reinforce the side walls of the gripping members to ensure adequate gripping forces. Although the projections are quite stiff, they can flex slightly to assist movement of a writing instrument into and out of the channel of a gripping member. The projections 14 converge slightly towards their free edges adjacent the channel mouth to urge the gripping member side walls to close around an inserted writing instrument of circular cross section.

Projecting downwardly from the bottom wall of each gripping member are three transverse rails 15 which are located at the ends and midway along the gripping member and which engage in respective slots in the base or cover. On their inside surfaces the side walls of each gripping member 10, 11 are provided with upright ribs 16. As shown in FIGS. 1–6 there are two pairs of ribs 16 on each side wall positioned symmetrically along this wall, and the ribs of each pair are longitudinally inclined in the direction away from the other pair. The ribs have been found extremely effective in providing a gentle gripping action while ensuring that a gripped writing instrument will not become displaced longitudinally as a consequence of the case being knocked endwise. Midway along the side walls inwardly directed studs or pips 18 are provided at the channel mouth, to provide additional security against a writing instrument becoming accidentally dislodged from the channel of the gripping member.

As may be clearly seen in FIG. 5, the upper edges of the side walls are convex, but this is not essential and this shape is for aesthetic reasons only. The side wall nearest the hinge of the gripping member shown fitted to the cover in FIGS. 1–3 has a notch 19 adjacent the shoulder 12 for defining with the cover wall 7 a groove which may be used to hold on the inside of the cover a removable information leaflet 20, or the like, which has an edge inserted into the groove.

Figure 7:
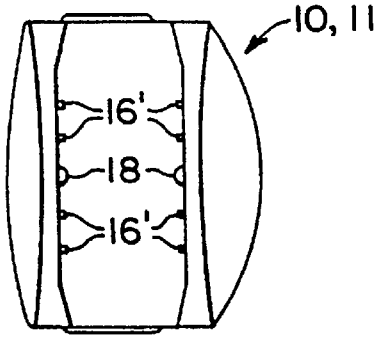
FIG. 7 is a view corresponding to FIG. 5 showing an alternative gripping device.

It is not essential for the ribs provided on the side walls of the gripping member to be inclined longitudinally, and straight ribs 16 directed substantially perpendicular to the longitudinal axis of the channel defined by a gripping member are a practical alternative and make the gripping member a little easier to manufacture. Such an embodiment is illustrated in FIG. 7. The straight ribs are still capable of deforming laterally by compression of the elastomeric material. As with the first embodiment, each side wall has two pairs of ribs. The thickness of the ribs is not crucial and they could be made with a thickness greater than as illustrated in the drawings.

The base 1 of the presentation case is shown moulded with a longitudinal recess 21 on its underside and this recess can receive ancillary articles or accessories, such as an ink cartridge for a pen, or a capsule of spare leads for a pencil, for use with the instruments enclosed within the case.

Figure 1:
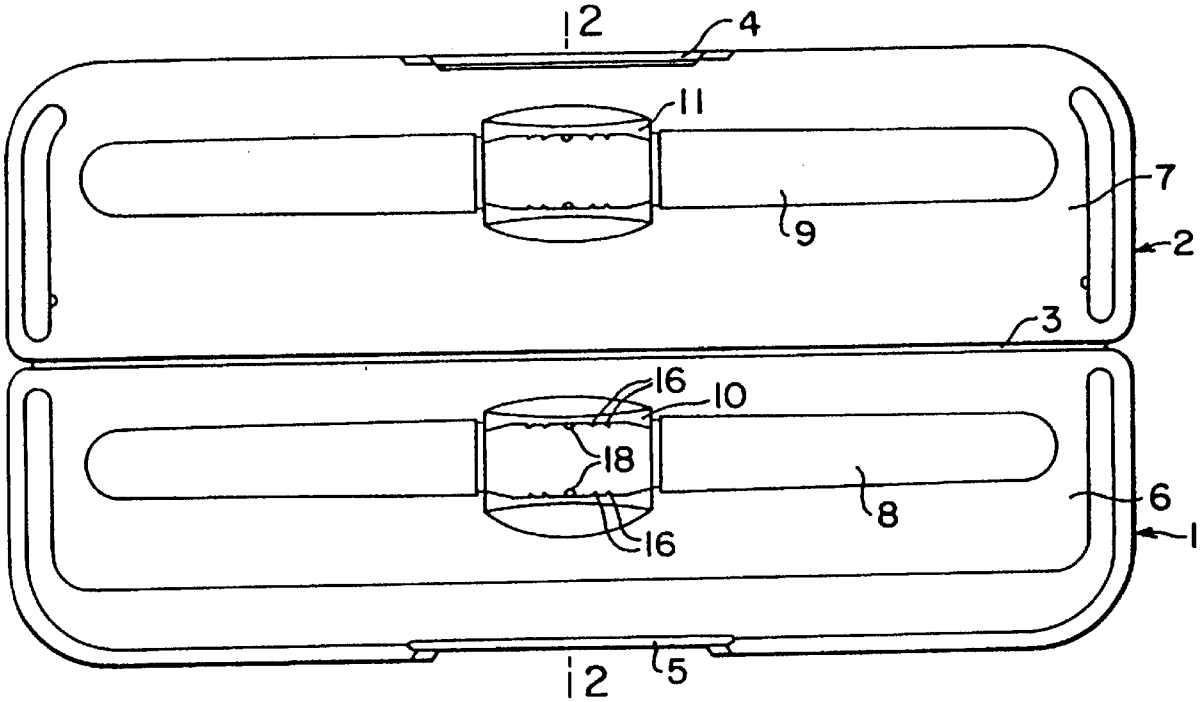
FIG. 1: is a plan view of a writing instrument presentation case embodying the invention and shown in an open condition.
Figure 4:
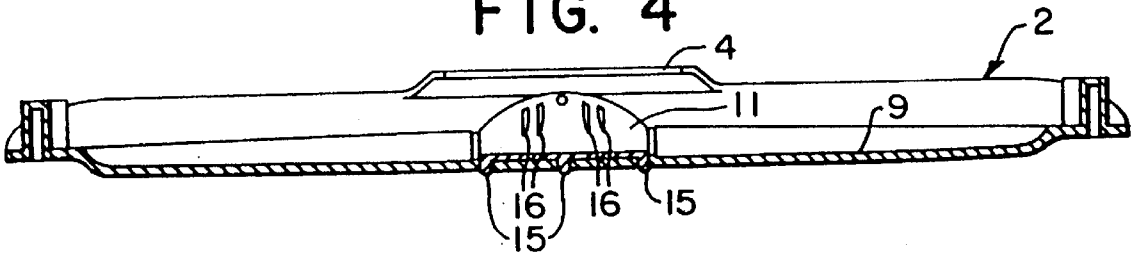
FIG. 4: is a section taken along the line IV—IV of FIG. 2.
Figure 2:
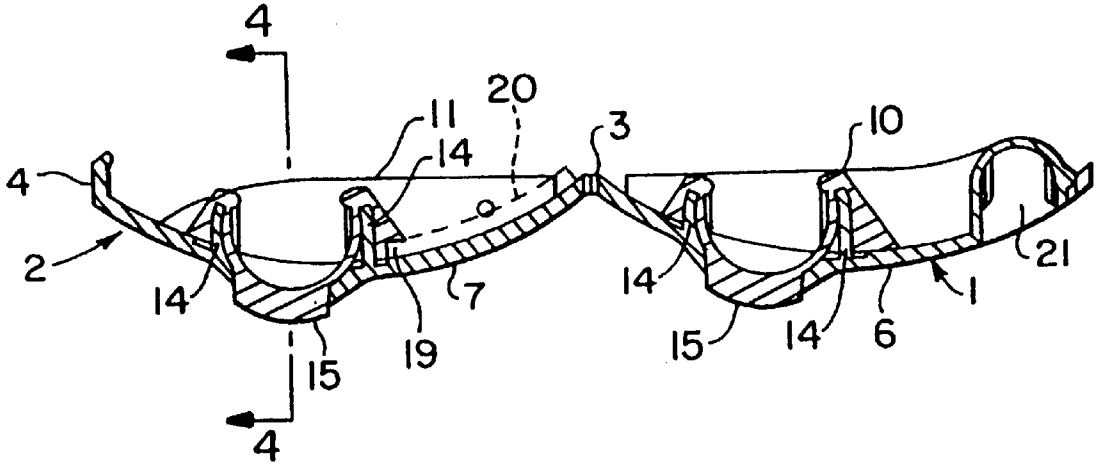
FIG. 2: is a cross section taken along the line II—II of FIG. 1.
Figure 3:
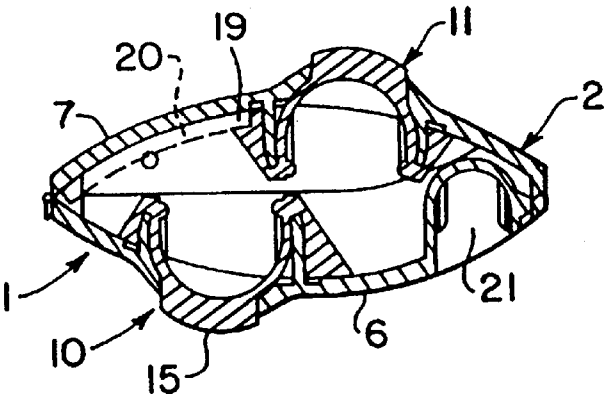
FIG. 3: is a section corresponding to FIG. 2 but showing the presentation case closed.

As may be seen in FIG. 3, the gripping members 10, 11 are positioned on the base and cover so that they will hold two writing instruments in close juxtaposition, but at different levels within the case when the case is closed. Indeed the two gripping members overlap laterally to a degree so that the side wall of one gripping member may assist in preventing a writing instrument becoming unintentionally dislodged from the other gripping member. However, the positioning of the writing instrument receiving parts is such that if only one instrument is enclosed and held on the base, upon opening the case it is not obviously apparent that the cover is adapted to hold a second instrument. The positioning of the groove 9 and gripping member 11 on the cover are such that they seem that they will directly overlie an instrument carried on the base. If the case is to be used for only one instrument, a gripping member need not necessarily be provided on the cover, and if desired it could be fitted with a different form of insert, for example to hold an information card.

The presentation case provides a compact container which is narrow and not excessively deep, but which is capable of holding securely and of presenting one or two writing instruments in an attractive display. Two writing instruments can be compactly retained in the closed case, yet when the case is opened they are displayed with a wide separation to enhance visibility and aesthetic appeal. Two writing instruments can be compactly retained in the closed case, yet when the case is opened they are displayed with a wide separation to enhance visibility and aesthetic appeal.

In the described embodiment the gripping members 10, 11 are made as separate mouldings and are subsequently assembled with the base and cover. As an alternative they could be made in one piece with the base and cover by a two part moulding process.

Figure 8:
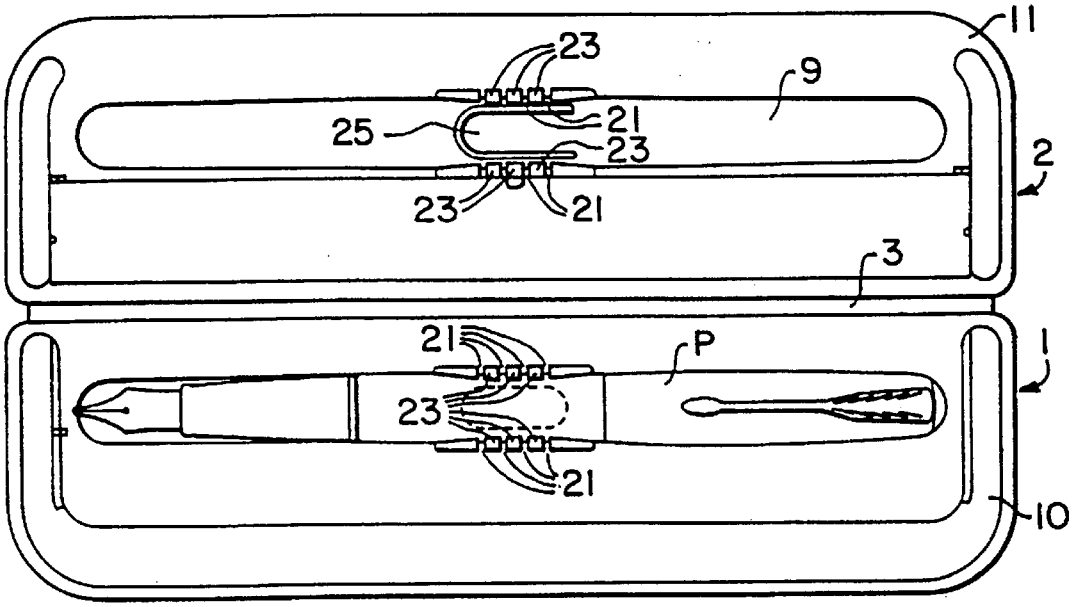
FIG. 8 is a view similar to FIG. 1 showing another writing instrument presentation case according to the invention.
Figure 9:
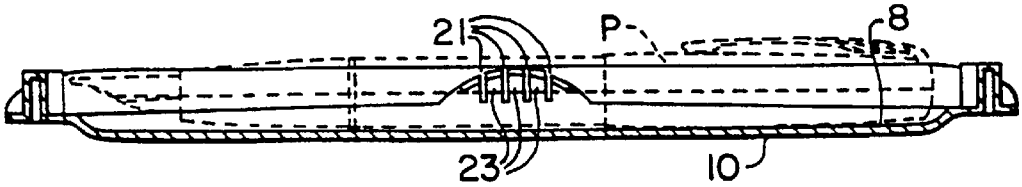
FIG. 9 is a section taken along the line IX—IX of FIG. 8.
Figure 10:
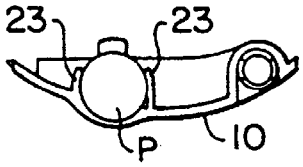
FIG. 10 is a transverse cross-section through the base of the presentation case taken along line X—X in FIG. 9.

An alternative embodiment is shown in FIGS. 8–10, but differs from that described above mainly in the form of the gripping devices for holding respective writing instruments on the base and cover. Separately moulded gripping members are not employed and instead the base 10 and cover 11 are each formed to define a channel with opposed side walls. Each of the side walls have four slots 21 defining three upright resilient fingers 23 having slightly in turned free ends for the fingers to embrace and grip a writing instrument inserted into the channel. The fingers 23 deflect laterally outwardly when a writing instrument is pushed into the channel and then spring back to grip and retain the instrument. A pen P is illustrated mounted on the base in FIGS. 8 and 10 and is shown in broken line in FIG. 9. As in the first embodiment, the cover is capable of holding a second instrument. As shown in FIG. 8 the bottom wall of the channel of the gripping device formed on the cover 11 is slotted to define a resilient tongue 25 which can be pushed from the outside to help remove a writing instrument from the gripping device. Alternatively a hole could be provided in the bottom wall of the channel as illustrated on the base 10 by broken line in FIG. 8.

We claim:

1. A case for writing instruments, comprising a base, a cover hinged to the base for movement between open and closed positions, writing instrument holding means carried by the base for receiving and holding a writing instrument in the case, and wherein the cover is adapted to carry a holding means for receiving and holding a second writing instrument in the case and in a position laterally alongside the writing instrument held on the base when the case is closed.

2. A case according to claim 1, wherein the cover carries a holding means of substantially the same form as the holding means on the base.

3. A case according to claim 1, wherein the holding means of the base and cover overlap laterally when the case is closed, both holding means being positioned to hold the writing instruments at different levels and in close juxtaposition in the closed case.

4. A case according to claim 1, wherein the holding means on the base comprises an insert of resilient material for gripping a portion of the writing instrument at a medial position along the writing instrument.

5. A case according to claim 4, wherein the insert is a channel shaped member of elastomeric material.

6. A case according to claim 5, wherein the channel shaped member has opposed side walls, and each side wall has at least two inwardly directed protrusions.

7. A writing instrument case having a gripping device for holding a writing instrument, the gripping device comprising a channel to receive a minor lengthwise section of the writing instrument for the writing instrument to be gripped between opposed side walls of the channel, each of the side walls including at least two laterally deformable elements spaced along the channel for resilient engagement with the writing instrument, wherein the side walls are integral with the case and are slotted to define laterally deformable elements in the form of resilient fingers with free ends at a channel opening.

8. A case according to claim 7, wherein the channel side walls are formed of elastomeric material and said laterally deformable elements comprise inwardly directed protrusions on the side walls.

9. A case according to claim 6, wherein each side wall has at least one first inwardly directed protrusion inclined longitudinally in one direction along the channel and at least one second inwardly directed protrusion inclined longitudinally in the other direction along the channel.

10. A case according to claim 9, wherein the protrusions are ribs and are arranged in adjacent pairs with the ribs of each pair being inclined in same longitudinal direction.

11. A case according to claim 6, wherein the protrusions are directed inwardly substantially perpendicularly to the length of the channel.

12. A case according to any one of claims 6, wherein the protrusions comprise ribs extending from adjacent the free edges of the side walls towards the bottom wall of the channel.

13. A case according to claim 12, wherein two pairs of adjacent ribs are provided on each side wall.

14. A case according to any one of claims 6, wherein the side walls are reinforced laterally by parts of stiffer material fixed to the case.

15. A case according to claim 14, wherein the side walls define shoulders externally of the channel and facing away from the channel opening, and sockets are defined in the side walls and open at said shoulders for receiving said reinforcing parts.

* * * * *